US007518316B2

(12) United States Patent
Yu

(10) Patent No.: US 7,518,316 B2
(45) Date of Patent: Apr. 14, 2009

(54) HALF-WAVE RECTIFICATION CIRCUIT WITH A LOW-PASS FILTER FOR LED LIGHT STRINGS

(75) Inventor: Jing Jing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 24 days.

(21) Appl. No.: 11/860,298

(22) Filed: Sep. 24, 2007

(65) Prior Publication Data

US 2008/0224623 A1 Sep. 18, 2008

Related U.S. Application Data

(63) Continuation-in-part of application No. 11/716,788, filed on Mar. 12, 2007, now abandoned.

(51) Int. Cl.
*H05B 37/00* (2006.01)

(52) U.S. Cl. ..... 315/200 R; 315/207; 315/205; 315/135; 315/123

(58) Field of Classification Search ..... 315/200 R, 315/201–208, 200 A, 135, 119, 123

See application file for complete search history.

(56) References Cited

U.S. PATENT DOCUMENTS

| | | | | |
|---|---|---|---|---|
| 2001/0043113 | A1 * | 11/2001 | Hoshino et al. | 327/534 |
| 2003/0025120 | A1 | 2/2003 | Chang | |
| 2004/0135522 | A1 | 7/2004 | Berman | |
| 2004/0233145 | A1 | 11/2004 | Chiang | |
| 2006/0007679 | A1 | 1/2006 | Allen | |
| 2006/0012349 | A1 | 1/2006 | Allen | |
| 2006/0180822 | A1 | 8/2006 | Yu | |
| 2006/0203482 | A1 | 9/2006 | Allen | |
| 2006/0270250 | A1 | 11/2006 | Allen | |

* cited by examiner

*Primary Examiner*—Tuyet Vo
(74) *Attorney, Agent, or Firm*—William W. Cochran; Cochran Freund & Young LLC

(57) ABSTRACT

Disclosed is a low cost LED string circuit design that uses an inexpensive half-wave rectification and low-pass filter circuit that is designed to produce minimal flicker in the LED string that is connected to the circuit. The components of the half-wave rectification and low-pass filter circuit are selected in accordance with design principles that prevent glittering and flickering of the LED string. The circuit components of the half-wave rectification and low-pass filter circuit can be embedded in an outlet plug or as a separate independent unit between an AC power plug and the LED string.

6 Claims, 4 Drawing Sheets

HALF-WAVE RECTIFICATION CIRCUIT WITH A LOW-PASS FILTER FOR LED LIGHT STRINGS

CROSS-REFERENCE TO RELATED APPLICATION

This application is a continuation-in-part of U.S. patent application Ser. No. 11/716,788, entitled "A Half-Wave Rectification Circuit With a Low-Pass Filter for LED Light Strings," by Jing Jing Yu, filed Mar. 12, 2007. The entire contents of the above mentioned application is hereby specifically incorporated herein by reference for all it discloses and teaches.

BACKGROUND OF THE INVENTION

Light emitting diode (LED) strings have been used as decorative lighting and have become an important part of daily life. The properties of LEDs, such as low operating voltage and power, small size, long lifetime and extended stability, make them desirable as lighting sources. Moreover, LEDs do not generate a substantial amount of heat and are safe for daily operation.

In conventional LED strings, LEDs are connected either directly to a standard household alternative current power source or through an AC to DC converter. Directly connecting an LED string to a household AC power source is inexpensive, but generates 60 Hz glitter because the LEDs in the light string only work under positive half-waves of the alternating current source. Moreover, when LEDs are connected to an alternating current power source, the lifetime of the LED is shortened, due to the negative voltage applied by the negative half-waves. The use of AC to DC converters with each LED light string becomes substantially more expensive.

SUMMARY OF THE INVENTION

An embodiment of the present invention may therefore comprise an LED string circuit comprising: a plug that is adapted to fit in a standard household electrical socket; a half-wave rectification and low-pass filter circuit disposed in the plug comprising: a resistor having a resistance (R) that is connected to a first lead of an alternating current power source having a frequency ($f_o$); a diode connected in series with the resistor; a capacitor connected between an output node of the diode and a second lead of the alternating current power source; an LED string, having a resistance ($R_{LED}$) that is connected to the output node of the diode and the second lead of the alternating current power source, the LED string having an effective resistance ($R_{LED}$); the capacitor having a capacitance (C) selected in accordance with:

$$C = \frac{R + R_{LED}}{2\pi R R_{LED} f_c}, \text{ and } f_c = \frac{2\eta f_o}{\pi},$$

and where $f_c << f_o$ and $\eta$ is the change in voltage applied to the LED string divided by the average voltage applied to the LED string.

An embodiment of the present invention may therefore further comprise a method of generating a substantially constant voltage for an LED string from an alternating current power source comprising: connecting a resistor having a resistance (R) to a first lead of the alternating current power source; connecting a diode in series with the resistor; connecting a capacitor having a capacitance (C) between an output node of the diode and a second lead of the alternating current power source; connecting the LED string between the output node of the diode and the second lead of the power source, the LED string having an effective resistance ($R_{LED}$); selecting the value of the capacitance of the capacitor in accordance with:

$$C = \frac{R + R_{LED}}{2\pi R R_{LED} f_c} \text{ and } f_c = \frac{2\eta f_o}{\pi}$$

where $f_c$ is the cut-off frequency of the circuit and $f_o$ is the frequency of the alternating current power source and $\eta$ is the change in voltage of the alternating current power source divided by the average voltage of the alternating current power source; selecting $f_c$ as follows: $f_c << f_o$.

DETAILED DESCRIPTION OF EMBODIMENTS OF THE INVENTION

Figure 1:
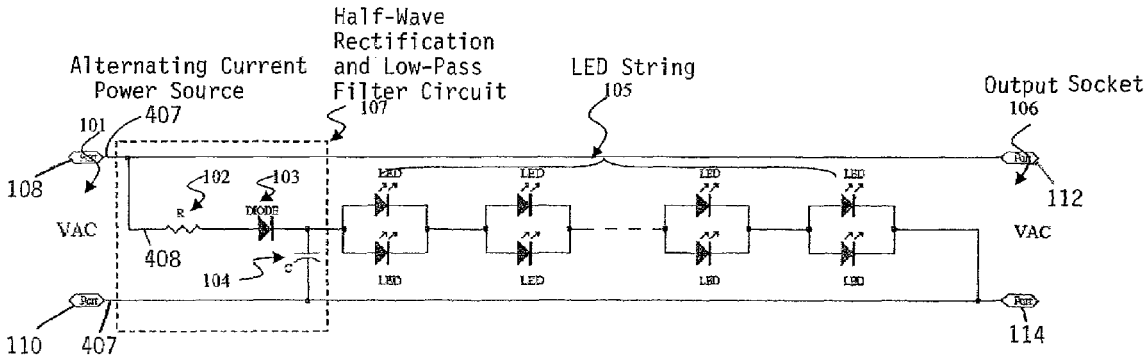
FIG. 1 is a schematic illustration of one embodiment of the present invention.

FIG. 1 is a circuit diagram of an LED string circuit that includes a half-wave rectification/low-pass filter circuit 107. As shown in FIG. 1, the half-wave rectifier/low-pass filter circuit 107 is an inexpensive circuit for providing a DC signal for LED string 105 that eliminates flicker and extends the lifetime of the LEDs 105. The half-wave rectifier/low-pass filter 107 provides a nearly constant DC voltage to the LED string 105 and utilizes low cost components, including a resistor 102, a diode 103 and a capacitor 104. The half-wave rectifier/low-pass filter 107 eliminates the cost of an AC to DC converter that is normally used in light strings to provide bright, non-glittering light sources. As shown in FIG. 1, an alternating current power source 101, such as a 117 volt rms household power source, is applied to input ports 108, 110. The half-wave rectification/low-pass filter circuit 107 is connected between the input ports 108, 110, the LED string 105 and output ports 112, 114 at output socket 106. As indicated above, the half-wave rectification/low-pass filter circuit 107 includes a resistor 102 and a rectification diode 103 that are connected in series with the LED string 105. Resistor 102 limits the operating voltage that is applied to the LED string 105. The diode 103 only passes positive half-wave signals, so that a half-wave rectified signal is applied to capacitor 104 that is connected between the output of the diode 103 and input port 110. The capacitor 104 filters the half-wave rectified signal and charges to the peak voltage of the half-wave rectified signal at the output of the diode 103. Of course, the output response of the half-wave rectification/low-pass filter circuit 107 and the stability of the output is determined by the cut-off frequency of the capacitor 104, as disclosed in more detail with respect to the description of FIGS. 3A, 3B and 3C.

Figure 2:
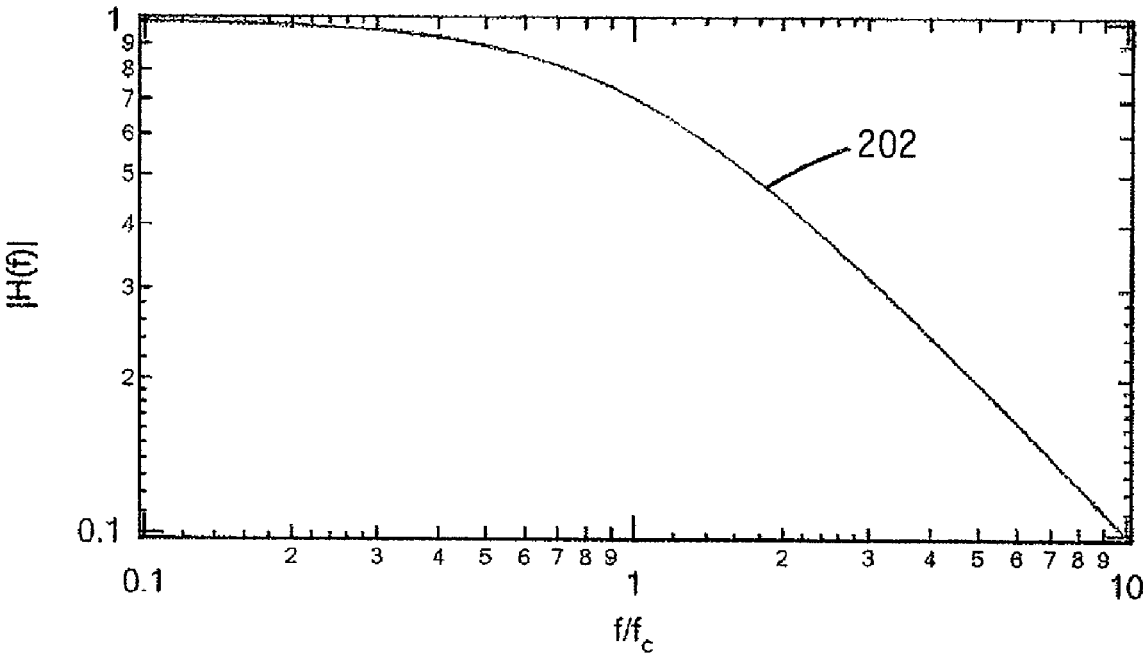
FIG. 2 is a graph of the transfer function of the low-pass filter.

FIG. 2 is a graph of the normalized magnitude of the transfer function H(f) versus the normalized frequency $f/f_c$ where $f_c$ is the cut-off frequency of the circuit of FIG. 1, and f is a frequency variable parameter that describes the performance of the low-pass filter circuit 107. As shown in FIG. 2, the graph 202 illustrates a substantial decrease in the transfer function as the normalized frequency increases.

Figures 3A, 3B, 3C:
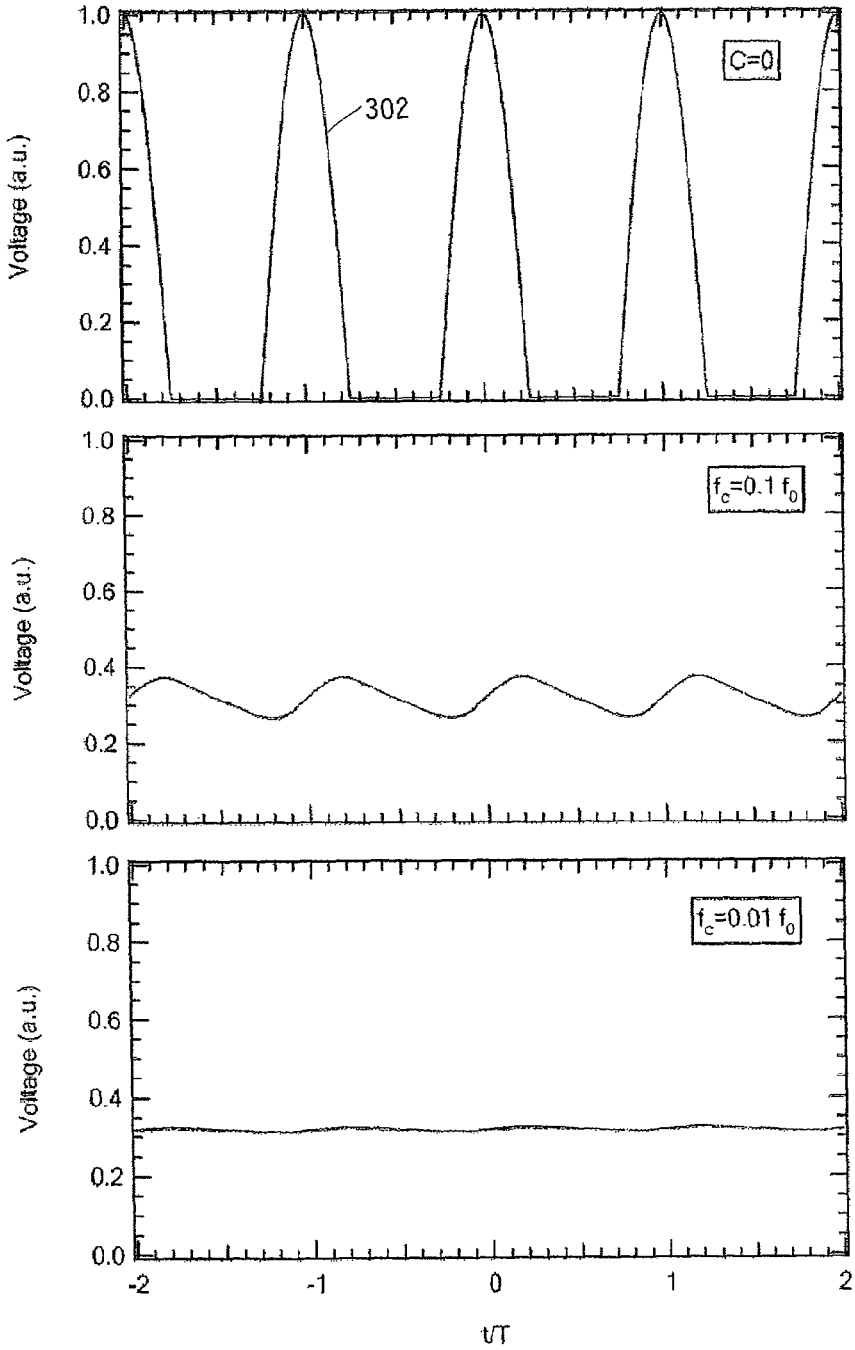
FIG. 3A is an illustration of the half-wave rectified voltage waveform applied to the LED string without the capacitor (C=0) in the circuit of FIG. 1.
FIG. 3B is an illustration of the voltage waveform applied to the LED string with a cut-off frequency of $f_c$=0.1 $f_0$ in the circuit of FIG. 1.
FIG. 3C is an illustration of the voltage waveform applied to the LED string with a cut-off frequency of $f_c$=0.01 $f_0$ in the circuit of FIG. 1.

FIG. 3A is a graph of the voltage response over time of the output of the half-wave rectification/low-pass filter circuit 107 when an alternating power source 101 is applied to the input nodes 108, 110, if capacitor 104 is removed from the circuit. As shown in FIG. 3A, a half-wave rectification signal 302 is generated without the capacitor 104. The half-wave rectified signal 302, that is illustrated in FIG. 3A, can be expressed mathematically by the sum of the Fourier series:

$$V(t) = \frac{V_0}{\pi} + \frac{V_0}{2}\cos(2\pi f_0 t) - \frac{2}{\pi}\sum_{n=1}^{\infty}\frac{(-1)^n}{4n^2-1}\cos(4\pi n f_0 t) \quad \text{(Eq. 1)}$$

where $V_0$ and $f_0$ are the voltage and frequency, respectively, of the alternating current power source 101. The first term on the right side of equation (1) is the DC average voltage. The second term is the AC component with the same frequency as $f_0$. The third term is the high order harmonic oscillation response. Hence, a low-pass filter that filters the higher order frequencies is capable of providing a nearly constant DC voltage at its output. The low-pass filtering effect is obtained by the resistor 102 and capacitor 104. The transfer function H(f) of the low-pass filter portion of the half-wave rectification and low-pass filter circuit 107 can be described as:

$$H(f) = \frac{R_{LED}/(R+R_{LED})}{1+i(f/f_c)}, \quad \text{(Eq. 2)}$$

where f is a frequency variable parameter that describes the performance of low-pass filter circuit 107 and is dependent only on the low-pass filter circuit 107, and $f_c$ is the cut-off frequency, which is defined by:

$$f_c = \frac{R+R_{LED}}{2\pi R R_{LED} C}. \quad \text{(Eq. 3)}$$

where $R_{LED}$ is the effective LED string resistance.

The magnitude of the transfer function is plotted in FIG. 2, as set forth above. As shown in FIG. 2, at the cut-off frequency, the magnitude drops by a factor of 50 percent.

The half-wave rectification/low-pass filter circuit 107 produces an output that is the voltage that is applied to the LED string over time [$V_{LED}(t)$], which is the combination of equations 1, 2 and 3 above, which can be expressed as follows:

$$V_{LED} = \frac{V_0}{\pi}H(0) + \frac{V_0}{4}[H(f_0)e^{i2\pi f_0 t} + H(-f_0)e^{-i2\pi f_0 t}] - \frac{1}{\pi}\sum_{n=1}^{\infty}\frac{(-1)^n}{4n^2-1}[H(2nf_0)e^{i4\pi n f_0 t} + H(-2nf_o)e^{-i4\pi n f_0 t}]. \quad \text{(Eq. 4)}$$

FIGS. 3B and 3C show the effect of the low-pass filter with two different cut-off frequencies ($f_c$). In the case where $f_c$=0.1 $f_0$, where $f_0$ is the frequency of standard household current (60 Hz), the voltage variation is about 17 percent of the average voltage, as illustrated in FIG. 3B. In the case where $f_c$=0.01 $f_0$, as shown in FIG. 3C, a nearly constant DC voltage is obtained. In the limit where $f_c \ll f_0$, keeping the first two terms on the right side of Equation 4, the estimate of voltage variation on the LED string is given as:

$$\eta = \frac{\Delta V}{\bar{V}} \cong \frac{\pi}{2}\left|\frac{H(f_0)}{H(0)}\right| = \left|\frac{\pi/2}{1+if_0/f_c}\right| = \frac{\pi/2}{\sqrt{1+(f_0/f_c)^2}} \xrightarrow{f_c \ll f_0} \frac{\pi f_c}{2f_0}, \quad \text{(Eq. 5)}$$

where the average voltage on the LED string is obtained from:

$$\bar{V} = \frac{V_0}{\pi}H(0) = \frac{V_0}{\pi}\frac{R_{LED}}{R+R_{LED}} \quad \text{(Eq. 6)}$$

Equations 1 through 6 provide the design principles for designing the circuit. For example, if the LED operating voltage is set to $\bar{V}$, with total effective LED string resistance at $R_{LED}$, the resistance value of R can be obtained from Equation 6. The voltage variance η can then be set to obtain the cut-off frequency $f_c$ from Equation 5. After $f_c$, R and $R_{LED}$ are determined, the value for C can be obtained from equation 3.

Figure 4:
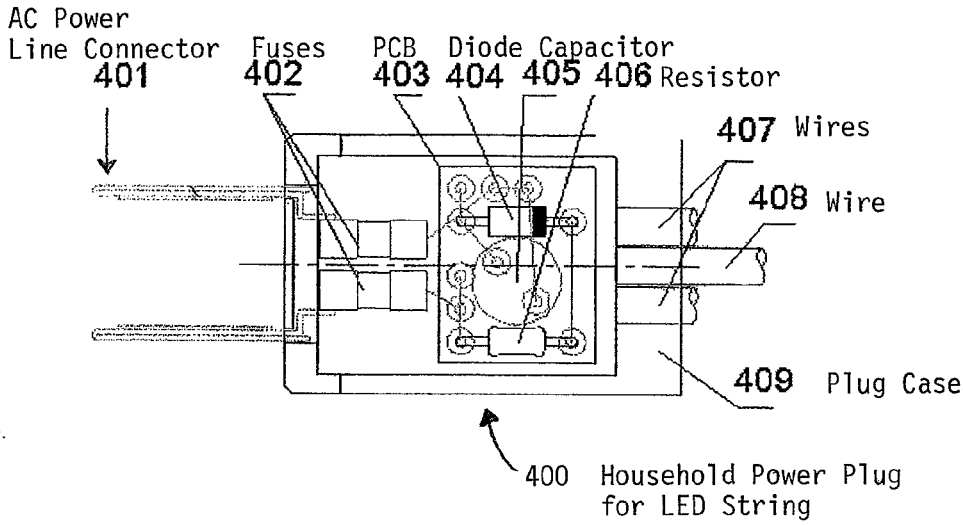
FIG. 4 is a schematic illustration of the layout of an integrated power plug that includes a printed circuit board incorporating an embodiment of the present invention.

FIG. 4 is a schematic illustration of the packaging that can be used for implementing the half-wave rectification/low-pass filter circuit 107. As shown in FIG. 4, a household power plug 400, for the LED string illustrated in FIG. 1, includes the half-wave rectification/low-pass filter circuit 107 that is enclosed within the plug case 409. The printed circuit board 403 includes diode 404, capacitor 405, and resistor 406. The printed circuit board 403 is small enough to fit within the plug case 409 of the power plug 400. Also included in the plug case 409 are the power line connectors 401 and the fuses 402. Fuses 402 can be mounted permanently within the plug case 409 or can be enclosed in housing so that the fuses 402 can be removed for replacement. The AC power line connectors 401 are adapted to fit directly into a standard power socket having standard alternating household current. Wires 407 and 408 are connected directly to the printed circuit board 403 and extend outwardly from the plug case 409. The plug case 409 can be a snap-together type of case, or can be over-molded with a plastic type of material. The over-molding of the printed circuit board, fuses and power line connectors provides a secure and sturdy housing for these components that protects these components from damage or becoming loose in a small package that is inexpensive to construct and creates minimal flickering in the LEDs.

Figure 5:
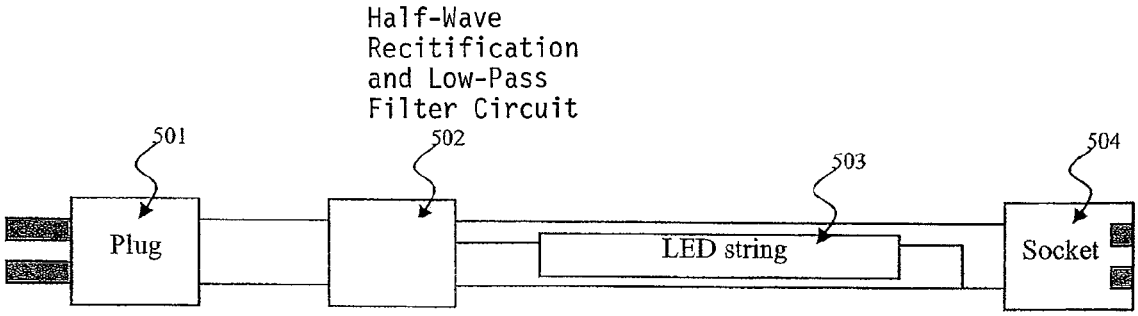
FIG. 5 is a schematic illustration of another embodiment in which an LED string and a half-wave rectification/low-pass filter circuit are packaged as independent units.

FIG. 5 is a schematic diagram of another embodiment. As shown in FIG. 5, the plug 501 is separate from the half-wave rectification and low-pass filter circuit 502. The half-wave rectification/low-pass filter circuits 502 can be constructed separately from the plug 501 and independently be connected to the plug 501. The LED string 503 and the socket 504 are then connected to the half-wave rectification/low-pass filter circuit 502.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An LED string circuit comprising:

a plug that is adapted to fit in a standard household electrical socket;

a half-wave rectification and low-pass filter circuit disposed in said plug comprising:

a resistor having a resistance (R) that is connected to a first lead of an alternating current power source having a frequency ($f_o$);

a diode connected in series with said resistor;

a capacitor connected between an output node of said diode and a second lead of said alternating current power source;

an LED string, having a resistance ($R_{LED}$) that is connected to said output node of said diode and said second lead of said alternating current power source, said LED string having an effective resistance ($R_{LED}$);

said capacitor having a capacitance (C) selected in accordance with:

$$C = \frac{R + R_{LED}}{2\pi R R_{LED} f_c}, \text{ and}$$

$$f_c = \frac{2\eta f_o}{\pi}, \text{ and}$$

where $f_c << f_o$ and η is the change in voltage that is applied to the LED string divided by the average voltage that is applied to the LED string.

2. The LED string circuit of claim 1 wherein $f_c << f_o$ to comprises $f_c$ having a value that is at least approximately two orders of magnitude less than $f_o$.

3. The LED string circuit of claim 2 wherein said printed circuit board is encapsulated in an over-molded plastic housing for said plug.

4. A method of generating a substantially constant voltage for an LED string from an alternating current power source comprising:

connecting a resistor having a resistance (R) to a first lead of said alternating current power source;

connecting a diode in series with said resistor;

connecting a capacitor having a capacitance (C) between an output node of said diode and a second lead of said alternating current power source;

connecting said LED string between said output node of said diode and said second lead of said power source, said LED string having an effective resistance ($R_{LED}$);

selecting the value of the capacitance of said capacitor in accordance with:

$$C = \frac{R + R_{LED}}{2\pi R R_{LED} f_c} \text{ and}$$

$$f_c = \frac{2\eta f_o}{\pi}$$

where $f_c$ is the cut-off frequency of the circuit and $f_o$ is the frequency of said alternating current power source and η is the change in voltage that is applied to the LED string divided by the average voltage that is applied to the LED string;

selecting $f_c$ as follows:

$$f_c << f_o.$$

5. The method of claim 4 wherein said process of selecting $f_c << f_o$ comprises selecting $f_c$ to be at least approximately two orders of magnitude less than $f_o$.

6. The method of claim 5 wherein said process of connecting said resistor, connecting said diode and connecting said capacitor further comprises:

connecting said resistor, said diode and said capacitor to a printed circuit board;

encapsulating said printed circuit board in an over-molded plastic housing for a plug.

* * * * *